US008409523B2

(12) United States Patent
Mendel-Hartvig et al.

(10) Patent No.: US 8,409,523 B2
(45) Date of Patent: Apr. 2, 2013

(54) ASSAY DEVICE COMPRISING SERIAL REACTION ZONES

(75) Inventors: Ib Mendel-Hartvig, Uppsala (SE); Gerd Rundström, Uppsala (SE); Per Ove Öhman, Uppsala (SE)

(73) Assignee: Amic AB (SE)

( * ) Notice: Subject to any disclaimer, the term of this patent is extended or adjusted under 35 U.S.C. 154(b) by 217 days.

(21) Appl. No.: 12/829,151

(22) Filed: Jul. 1, 2010

(65) Prior Publication Data

US 2011/0003398 A1 Jan. 6, 2011

Related U.S. Application Data

(60) Provisional application No. 61/222,866, filed on Jul. 2, 2009.

(30) Foreign Application Priority Data

Jul. 2, 2009 (SE) ..... 0950518

(51) Int. Cl.
*G01N 31/22* (2006.01)

(52) U.S. Cl. ..... 422/403; 422/400; 422/402; 422/82.08; 422/420

(58) Field of Classification Search ..... None
See application file for complete search history.

(56) References Cited

U.S. PATENT DOCUMENTS

| | | | |
|---|---|---|---|
| 3,973,129 | A | 8/1976 | Blumberg et al. |
| 4,956,150 | A | 9/1990 | Henry |
| 5,124,172 | A | 6/1992 | Burrell et al. |
| 5,158,720 | A | 10/1992 | Levy |
| 5,344,784 | A | 9/1994 | Attridge |
| 5,399,499 | A | 3/1995 | Paz-Pujait et al. |
| 5,540,888 | A | 7/1996 | Bunce et al. |
| 5,619,601 | A | 4/1997 | Akashi et al. |
| 5,837,115 | A | 11/1998 | Austin et al. |
| 5,885,527 | A | 3/1999 | Buechler |

(Continued)

FOREIGN PATENT DOCUMENTS

| | | |
|---|---|---|
| EP | 0348006 | 12/1993 |
| EP | 1120164 A2 | 8/2001 |

(Continued)

OTHER PUBLICATIONS

International Search Report and Written Opinion, mailed Jul. 26, 2005, for International Patent Application No. PCT/SE2005/000429, filed Mar. 23, 2005, 7 pages.

(Continued)

*Primary Examiner* — Yelena G Gakh
*Assistant Examiner* — Christopher A Hixson
(74) *Attorney, Agent, or Firm* — Hisock & Barclay, LLP

(57) ABSTRACT

An analysis device having at least one sample addition zone, at least one sink, and at least one flow path connecting the at least one sample addition zone and the at least one sink. The at least one flow path includes projections substantially vertical to the surface of the substrate and having a height (H), diameter (D) and reciprocal spacing (t1, t2) such that lateral capillary flow of a liquid sample is achieved. The device includes at least two reaction zones in series, wherein each reaction zone is adapted to facilitating measurement of a response originating from one and the same analyte, and wherein the reaction zones are positioned to allow calculation of the concentration of at least one analyte. Advantages include that a more accurate value can be calculated, variations are reduced, and an estimation of the uncertainty of the response can be calculated.

11 Claims, 2 Drawing Sheets

U.S. PATENT DOCUMENTS

| | | | | |
|---|---|---|---|---|
| 6,143,576 | A | 11/2000 | Buechler | |
| 6,150,178 | A | 11/2000 | Cesarczyk et al. | |
| 6,156,270 | A | 12/2000 | Buechler | |
| 6,156,273 | A | 12/2000 | Regnier et al. | |
| 6,258,548 | B1 * | 7/2001 | Buck | 435/7.1 |
| 6,296,020 | B1 | 10/2001 | McNeely et al. | |
| 6,368,871 | B1 | 4/2002 | Christel et al. | |
| 6,416,642 | B1 | 7/2002 | Alajoki et al. | |
| 6,436,722 | B1 | 8/2002 | Clark et al. | |
| 6,454,924 | B2 | 9/2002 | Jedrzejewski et al. | |
| 6,710,870 | B1 | 3/2004 | Marowsky et al. | |
| 6,762,059 | B2 | 7/2004 | Chan et al. | |
| 6,767,510 | B1 | 7/2004 | Buechler | |
| 2002/0004246 | A1 | 1/2002 | Daniels et al. | |
| 2002/0039783 | A1 | 4/2002 | McMillan et al. | |
| 2003/0035758 | A1 | 2/2003 | Buechler et al. | |
| 2004/0077103 | A1 | 4/2004 | Buechler | |
| 2004/0126767 | A1 | 7/2004 | Anderberg et al. | |
| 2004/0142495 | A1 | 7/2004 | Hartman et al. | |
| 2004/0191127 | A1 | 9/2004 | Komblit et al. | |
| 2005/0042766 | A1 | 2/2005 | Ohman et al. | |
| 2005/0136552 | A1 | 6/2005 | Buechler | |
| 2008/0099331 | A1 * | 5/2008 | Hsiung et al. | 204/403.01 |
| 2008/0273918 | A1 | 11/2008 | Linder et al. | |

FOREIGN PATENT DOCUMENTS

| | | | |
|---|---|---|---|
| EP | 1371984 | A1 | 12/2003 |
| JP | 2002001102 | A | 1/2002 |
| WO | WO 9201226 | | 1/1992 |
| WO | WO 9854568 | | 12/1998 |
| WO | WO 9946596 | A1 | 9/1999 |
| WO | WO 0102093 | A2 | 1/2001 |
| WO | WO 0127627 | A2 | 4/2001 |
| WO | WO 0157501 | A1 | 8/2001 |
| WO | WO 03103835 | A1 | 12/2003 |
| WO | WO 2004037374 | A2 | 5/2004 |
| WO | WO 2005089082 | A2 | 9/2005 |
| WO | WO 2005118139 | A1 | 12/2005 |
| WO | WO 2006135286 | A1 | 12/2006 |
| WO | WO 2008137008 | A2 | 11/2008 |

OTHER PUBLICATIONS

International Search Report and Written Opinion, mailed Sep. 6, 2005, for International Patent Application No. PCT/SE2005/000787, filed May 26, 2005, 6 pages.

International Search Report (and Written Opinion) mailed Aug. 8, 2003, for International Patent Application No. PCT/SE03/00919 filed on Jun. 4, 2003, 2 pages.

GUM (Guide to the Expression of Uncertainty in Measurement, International Organisation of Standardisation, ISO, Genève, 1995) Joint Committee for Guides in Metrology (JCGM/WG 1) GUM 1995 with minor corrections, First Edition, Sep. 2008; 134 pages.

* cited by examiner

ASSAY DEVICE COMPRISING SERIAL REACTION ZONES

CROSS REFERENCE TO RELATED APPLICATIONS

This application is based upon U.S. Ser. No. 61/222,866, entitled NEW METHOD AND DEVICE, filed Jul. 2, 2009 and Swedish Patent Application No. SE 0950518-1, filed Jul. 2, 2009, pursuant to relevant sections of 35 USC §119, the entire contents of each document herein being incorporated by reference.

TECHNICAL FIELD OF THE INVENTION

The present invention relates to an improved lateral flow device and a method involving the device.

BACKGROUND OF THE INVENTION

The uncertainty of a result is an important measure of the quality of the result. The terms "uncertainty of a result" and "uncertainty of a measurement" comprise an evaluation of the precision of the method leading to the result or measurement. All parts of the method or measurement, which possibly influence the quality, need to be considered. In the instance of a clinical analysis or assay, information about the uncertainty of the results should preferably be available.

The European co-operation for Accreditation, EA, have designated GUM (Guide to the Expression of Uncertainty in Measurement, International Organisation of Standardisation, ISO, Genève, 1995) as the "master document" for estimation of uncertainty of measurement. This document is incorporated herein by reference in its entirety.

PCT/SE03/00919 relates to a micro fluidic system comprising a substrate and provided on said substrate there is at least one flow path comprising a plurality of micro posts protruding upwards from said substrate, the spacing between the micro posts being small enough to induce a capillary action in a liquid sample applied, so as to force said liquid to move. It is disclosed that the device can comprise a denser zone which can act as a sieve preventing for instance cells to pass. There is also disclosed an embodiment with microstructures where the shape, size and/or center-to-center distance forms a gradient so that the movement of a fraction of the sample, a cell type or the like can be delayed and optionally separated.

PCT/SE2005/000429 shows a device and method for the separation of a component in a liquid sample prior to the detection of an analyte in said sample, wherein a sample is added to a receiving zone on a substrate. The substrate further optionally comprises a reaction zone, a transport or incubation zone connecting the receiving and reaction zone, respectively, forming a flow path on a substrate. The substrate is a non-porous substrate, and at least part of said flow path consists of areas of projections substantially vertical to the surface of said substrate, and having a height, diameter and reciprocal spacing such, that lateral capillary flow of said liquid sample in said zone is achieved, and where means for separation are provided adjacent to the zone for receiving the sample. There is disclosed an embodiment where red blood cells are removed.

WO 2005/118139 concerns a device for handling liquid samples, comprising a flow path with at least one zone for receiving the sample, and a transport or incubation zone, said zones connected by or comprising a zone having projections substantially vertical to its surface. The device is provided with a sink with a capacity of receiving said liquid sample, said sink comprising a zone having projections substantially vertical to its surface, and said sink being adapted to respond to an external influence regulating its capacity to receive said liquid sample. It is disclosed that the device can be used when particulate matter, such as cells, is to be removed from the bulk of the sample. It is stated that red blood cells can be separated without significant rupture of the cells.

In lateral flow assay devices in which the result is read in a reaction zone, there may under certain circumstances occur variations in the result due to variations in, for instance, the deposition of reagents on the assay device, binding of reagents to the assay device, drying of the reagents on the assay device, and reading of a signal from the assay device.

WO 2008/137008 to Claros Diagnostics Inc. discloses a device which has a reagent arranged in a microfluidic channel of a microfluidic system of a substrate. A fluidic connector includes a fluid path with a fluid path inlet and a fluid path outlet connected to an outlet and an inlet of microfluidic channels to allow fluid communication between the path and the channels, respectively. The path contains a sample or the reagent arranged prior to connection of the connector to the substrate. There are disclosed embodiments where the reaction area comprises at least two meandering channel regions connected in series. It is disclosed that detection zones can be connected in series. It is disclosed that the detected signal can be different at different portions of a region. A problem in WO 2008/137008 is that this device is still susceptible to variations in factors such as deposition of reagents on the assay device, binding of reagents to the assay device, drying of the reagents on the assay device, and reading of a signal from the assay device.

US 2008273918 discloses fluidic connectors, methods, and devices for performing analyses (e.g., immunoassays) in microfluidic systems.

WO 01/02093 discloses a detection article, including at least one fluid control film layer having at least one microstructured major surface with a plurality of microchannels therein.

Although the state of the art lateral flow assay devices can be used satisfactorily, there is always a need for improved devices and methods where the accuracy is increased and variations in the results are decreased. There is also a need for devices and methods where an estimate of the uncertainty can be provided.

Problems in the state of the art include variations in the deposition of reagents in the reaction zone on the assay device, binding of reagents, drying of the reagents, and reading of a signal from the assay device. Such variations, and possibly others, may introduce variations in the response, which is read from the analysis device.

SUMMARY OF THE INVENTION

It is an object of the present invention to obviate at least some of the disadvantages of the prior art and provide an improved device, an improved system and an improved method.

In a first aspect, there is provided an analysis device comprising at least one sample addition zone, at least one sink, and at least one flow path connecting the at least one sample addition zone and the at least one sink, wherein the at least one flow path comprises projections substantially vertical to the surface of said substrate and having a height (H), diameter (D) and reciprocal spacing (t1, t2) such that lateral capillary flow of a liquid sample is achieved, wherein the device comprises at least two reaction zones in series, wherein each reaction zone is adapted to facilitating measurement of a response originating from one and the same analyte, and wherein the reaction zones are positioned to allow calculation of the concentration of at least one analyte.

In a second aspect, there is provided a system comprising an analysis device as described above and a reader adapted to read a response from each of the at least two reaction zones in series, wherein the reader comprises a microprocessor adapted to calculate a concentration based on the measured responses.

In a third aspect, there is provided a method of performing an analysis comprising the steps:

a) providing an analysis device comprising at least one sample addition zone, at least one sink, and at least one flow path connecting the at least one sample addition zone and the at least one sink, wherein the at least one flow path comprises projections substantially vertical to the surface of said substrate and having a height (H), diameter (D) and reciprocal spacing (t1, t2) such that lateral capillary flow of a liquid sample is achieved, wherein the device comprises at least two reaction zones in series, wherein each reaction zone is adapted to facilitating measurement of a response originating from one and the same analyte, b) measuring a response in each reaction zone, wherein the responses originate from one and the same analyte, and c) calculating the concentration of at least one analyte based on the measured at least two responses.

Further aspects and embodiments are defined in the appended claims.

There is described a lateral flow assay device with several reaction zones in series where responses are read. Similar, but not necessarily identical responses, are read in the several reaction zones, and thus, for instance, a concentration of an analyte and an estimate of the uncertainty may be calculated based upon the measured responses. Most often the measured values in the reactions zones in series are not identical depending of factors including, but not limited to, sample concentration, types of assay, amount of sample and distance between the serial reaction zones. Features include that several responses are read in at least two reaction zones in series. The at least two values are used in the calculation of the end result, including an estimate of the uncertainty.

Among the advantages provided are that there are further possibilities to control the signals that can be read from the different reaction zones. Additionally, a more accurate value can be calculated. Variations may originate from variables such as, but not limited to deposition, binding, drying and reading. Effects of such variations are reduced by this invention. The invention allows the estimation of the uncertainty in the result.

BRIEF DESCRIPTION OF THE DRAWINGS

The invention is described in greater detail with reference to the drawings in which.

DETAILED DESCRIPTION OF THE INVENTION

Definitions

Figure 1:
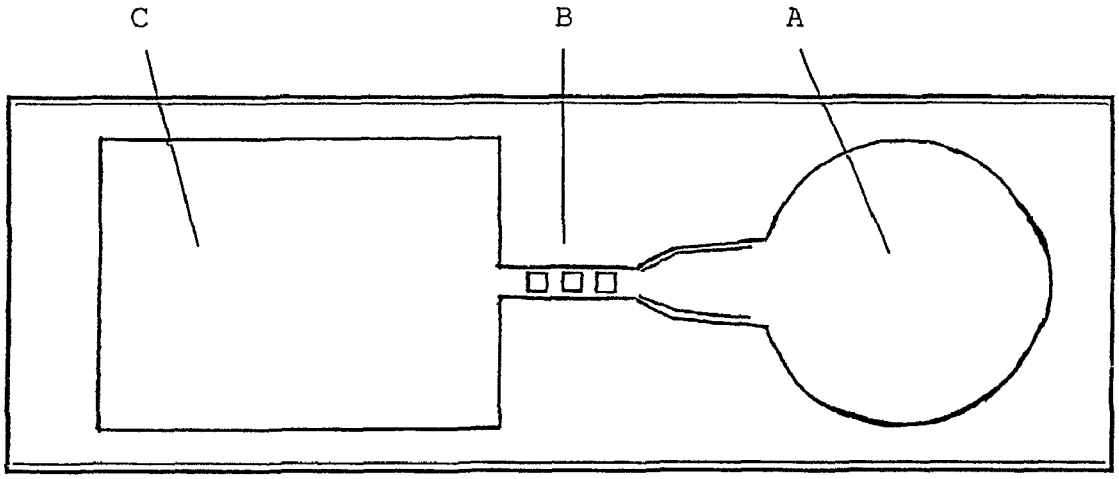
FIG. 1 shows a schematic picture of a flow chip with a sample addition zone A, one flow path with three reaction zones in series B, and a sink C.

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

The term "about" as used in connection with a numerical value throughout the description and the claims denotes an interval of accuracy, familiar and acceptable to a person skilled in the art. Said interval is ±10%.

As used throughout the claims and the description, the term "analysis" means the process in which at least one analyte is determined.

As used throughout the claims and the description, the term "analysis device" means a device which is used to analyze a sample. A diagnostic device is a non limiting example of an analysis device.

As used throughout the claims and the description, the term "analyte" means a substance or chemical or biological constituent of which one or more properties are determined in an analytical procedure. An analyte or a component itself can often not be measured, but a measurable property of the analyte can. For instance, it is possible to measure the concentration of an analyte.

As used throughout the claims and the description, the term "capillary flow" means flow induced mainly by capillary force.

As used throughout the claims and the description, the term "flow path" means an area on the device where flow of liquid can occur between different zones.

As used throughout the claims and the description, the term "open" used in connection with capillary flow means that the system is open; i.e., the system is without at lid entirely, or if there is a lid or partial lid, the lid is not in capillary contact with the sample liquid, i.e. a lid shall not take part in creating the capillary force.

As used throughout the claims and the description, the term "reciprocal spacing" means the distance between adjacent projections.

As used throughout the claims and the description, the term "reaction zone" means an area on an analysis device where molecules in a sample can be detected.

As used throughout the claims and the description, the term "response" means a measurable phenomenon originating from a reaction zone on the analysis device. The response includes but is not limited to light emitted from fluorescent molecules.

As used throughout the claims and the description, the term "sample addition zone" means a zone where a sample is added.

As used throughout the claims and the description, the term "sink" means an area with the capacity of receiving liquid sample.

In a first aspect, there is provided an analysis device comprising at least one sample addition zone, at least one sink, and at least one flow path connecting the sample addition zone and the sink, wherein the flow path comprises projections substantially vertical to the surface of said substrate and having a height (H), diameter (D) and reciprocal spacing (t1, t2) such that lateral capillary flow of a liquid sample is achieved, wherein the device comprises at least two reaction zones in series. Each reaction zone is adapted to facilitate measurement of a response originating from one and the same analyte, wherein the reaction zones are positioned to allow calculation of the concentration of at least one analyte.

The exact position of the reaction zones can vary, different positions are conceived as long as the concentration of at least one analyte can be calculated. The fact that the reaction zones are positioned to allow calculation of the concentration of at least one analyte means that the reaction zones either are positioned in places where the measured responses from one and the same analyte are approximately the same within the uncertainty of the measurement, or that they are positioned so that the measured responses from one and the same analyte are different but in a predictable manner, so that the concentration can be calculated. One example of the latter case is two reaction zones placed in series with a short distance therebetween. The first may give rise to one measured response and the second may give rise to a lower measured response, depending on factors such as the distance between the reaction zones and the assay which is used. Experiments may, for instance, conclude that the measured response in the second zone always is a certain fraction of the measured response in the first zone. In one embodiment the reaction zones are positioned so that the measured responses from one and the same analyte are the same within the uncertainty of the measurement.

In one embodiment, the reaction zone closest to the sample addition zone has an area which is different than the area of any one of the other reaction zones. In one embodiment, the reaction zone closest to the sample addition zone has an area which is smaller than the area of any one of the other reaction zones. In one embodiment, the reaction zone closest to the sample addition zone has the smallest area, and the reaction furthest from the sample addition zone has the largest area. In one embodiment, the analysis device comprises three reaction zones in which the reaction zone closest to the sample addition zone has the smallest area, the reaction furthest from the sample addition zone has the largest area, and the intermediate reaction zone has the second smallest area. The possibility to adjust the area of the reaction zone provides a possibility to control the amount and fraction in the sample that binds to reagent in the reaction zone. Thus, it is possible to let a certain suitable fraction of sample bind to the reaction zone closest to the sample addition zone. If the reaction zone closest to the sample addition zone is not made too large a useful amount of sample will be left in the sample fluid and will flow to the remaining reaction zones. Thus, it is possible to vary the areas of the reaction zones in order to obtain suitable signal responses from all reaction zones for a sample.

In one embodiment, the reaction zones have different geometries. In one embodiment, the reaction zone closest to the sample addition zone has a width which is smaller than the width of any one of the other reaction zones. In one embodiment, the reaction zone closest to the sample addition zone has a longitudinal shape as seen in the direction of the flow. In one embodiment, the reaction zone furthest from the sample addition zone extends over the entire width of the flow path. In one embodiment there are three reaction zones, in which the reaction zone closest to the sample addition zone has a longitudinal shape as seen in the direction of the flow with a small width, the intermediate reaction zone has a cross section which is a part of the width of the flow path, and the reaction zone furthest from the sample addition zone extends over the entire width of the flow path. In one embodiment, the reaction zone closest to the sample addition zone has a width corresponding to 10-25% of the width of the flow path, the intermediate reaction zone has a width corresponding to 25-75% of the flow path, and the reaction zone furthest from the sample addition zone extends over the entire width of the flow path Thus, there is provided further possibilities to vary the geometry and width of the reaction zones in order to further control the signal form the different reaction zones. The signal from the different reaction zones can be adjusted using this approach. Further there is the advantage that the flow of sample liquid is better accommodated and there is the possibility to design the reaction zones so that the flow of sample liquid is facilitated.

In one embodiment, each reaction zone comprises at least one reagent and the concentrations of reagent in the reaction zones are different. In one embodiment, the reaction zone closest to the sample addition zone has a concentration of reagent which is lower than the concentration of reagent in any one of the other reaction zones. In one embodiment there are three reaction zones, the reaction zone closest to the sample addition zone having the lowest concentration of reagent, the intermediate reaction zone having an intermediate concentration of reagent and the reaction zone furthest from the sample addition zone having the highest concentration of reagent. In this way, there is provided yet another possibility to control the signals from the different reaction zones.

Figure 2:
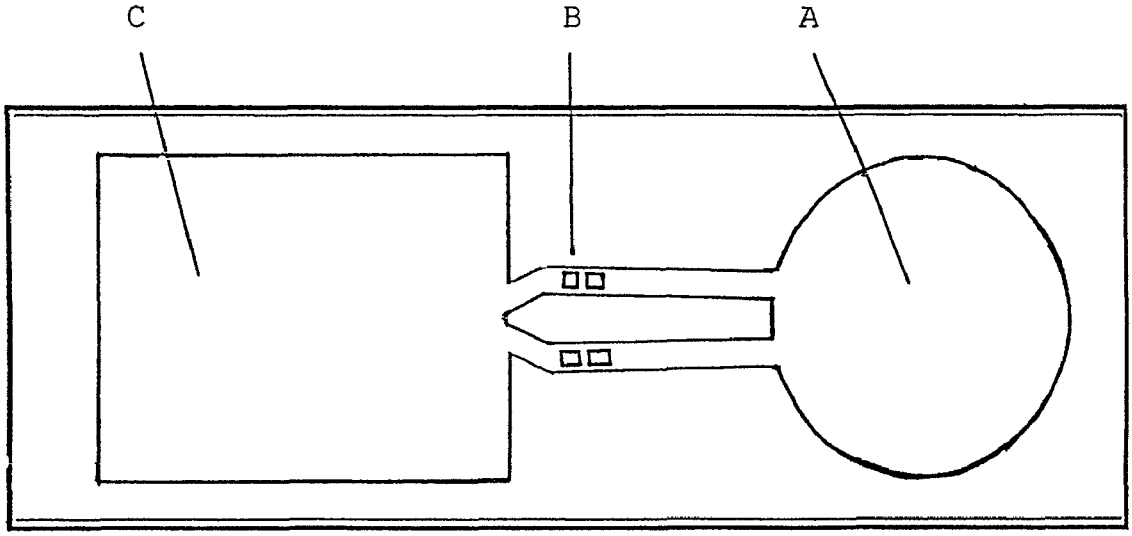
FIG. 2 shows a schematic picture of a flow chip with a sample addition zone A, two flow paths where each flow path have two reaction zones in series B, and a sink C.

In one embodiment, the serial reaction zones are positioned in one (single) flow path. In one embodiment, the analysis device comprises at least two flow paths connecting the sample addition zone and the sink, and wherein each flow path comprises at least two reaction zones. This latter embodiment provides a possibility to reduce the effects of variations in flow between different flow paths. An example of such an embodiment is depicted in FIG. 2.

In one embodiment, the flow path is at least partially open.

In a second aspect, there is provided a system comprising an analysis device as described above and a reader adapted to read a response from each of the at least two reaction zones in series, wherein the reader comprises a microprocessor adapted to calculate a concentration based on the measured responses.

A person skilled in the art can in the light of this description let the microprocessor calculate values including, but not limited to, a concentration of an analyte, a calculated response value, a sum, and an estimate of the uncertainty based on the measured responses using known algorithms and based on experiments in order to weight the measured responses from the at least two reaction zones in series.

In one embodiment, the reader of the system comprises a fluorescence reader.

In a third aspect, there is provided a method of performing an analysis comprising the steps:

a) providing an analysis device comprising at least one sample addition zone, at least one sink, and at least one flow path connecting the at least one sample addition zone and the at least one sink, wherein the at least one flow path comprises projections substantially vertical to the surface of said substrate and having a height (H), diameter (D) and reciprocal spacing (t1, t2) such that lateral capillary flow of a liquid sample is achieved, wherein the device comprises at least two reaction zones in series, wherein each reaction zone is adapted to facilitating measurement of a response originating from one and the same analyte, b) measuring a response in each reaction zone, wherein the responses originate from one and the same analyte and c) calculating the concentration of at least one analyte based on the measured at least two responses.

In one embodiment, the responses measured in the at least two reaction zones are different. This situation is the most likely. When the reaction zones are positioned in series, the measured responses are typically different. The calculation of a value from the responses can thus not in general follow an established scheme for the calculation of a mean value. Experiments have to be performed in order to ascertain that the measured at least two values are correctly weighted in relation to each other.

The responses which are measured from the analysis device are used for calculating various values including, but not limited to, the concentration of an analyte and an estimate of the uncertainty. In one embodiment, a calculated concentration and an estimate of the associated uncertainty are calculated based on the measured responses and based on calibration experiments. In one embodiment, a sum and an estimate of the associated uncertainty are calculated based on the measured responses.

The measured responses are used to calculate a concentration of an analyte. Often this is accomplished with a standard curve. A person skilled in the art can in the light of this description obtain a standard curve by measuring samples with known concentrations of an analyte. The skilled person can then use such a standard curve to calculate the concentration from the measured responses. Also, the fact that the at least two reaction zones in series may give different results have to be considered by performing experiments.

The invention allows an estimate of the uncertainty to be calculated. In one embodiment the concentration of at least one analyte and an estimate of the associated uncertainty of the concentration are calculated based on the measured responses.

It is possible to practice the principles of the invention in flow based assays, as well as other platforms other than those comprising projections substantially vertical to the surface. Examples of such include, but are not limited to, assays comprising porous materials, assay devices comprising nitrocellulose, capillary systems covered by a lid in capillary contact with the sample fluid, assay devices where flow is driven by electro osmosis, assay devices where flow is driven by centrifugation, and assay devices where flow is driven by a pump.

Other features of the invention and their associated advantages will be evident to a person skilled in the art upon reading the description and the examples.

It is to be understood that this invention is not limited to the particular embodiments shown here. The following examples are provided for illustrative purposes and are not intended to limit the scope of the invention since the scope of the present invention is limited only by the appended claims and equivalents thereof.

EXAMPLES

Plastic substrate chips made of Zeonor (Zeon, Japan) having oxidized dextran on the surface for covalently immobilization of proteins via Shiffs base coupling were used. Three reaction zones in the flow channel were deposited (Biodot AD3200) with 60 nl of 1 mg/ml anti-CRP mAb (Fitzgerald Ind. US, M701289). A device as schematically depicted in FIG. 1 was used. After 15 min the chips were dried at 20% humidity and 30° C. To test the binding in the three reaction zones a model system with fluorophore-labelled CRP was used. CRP was fluorescently labelled according to the supplier's instructions using Alexa Fluor® 647 Protein Labelling Kit (Invitrogen, US). Labelled CRP was added to CRP depleted serum (Scipack, UK) resulting in a final concentration of 80 ng/ml.

15 μl of sample was added to the sample zone of the chip and the capillary action of the micropillar array distributed the sample across the reaction zone into the wicking zone. The flow channel was then washed three times with 7.5 μl of buffert (50 mM Tris-buffert pH 7.5). A typical assay time was about 10 minutes. The signal intensities were recorded in a prototype line-illuminating fluorescence scanner. A new chip was used for each assay and the total number of chips was 25. The result from the experiment is shown in Table 1. CV is the coefficient of variation and is a normalized measure of dispersion of a probability distribution. It is defined as the ratio of the standard deviation to the mean.

TABLE 1

Comparison of the imprecision calculated from one or all the reaction zones

| Reaction zone | Mean relative signal | Imprecision (% CV) |
|---|---|---|
| 1 | 192 | 8 |
| 2 | 139 | 7 |
| 3 | 113 | 9 |
| All three | 444 | 5 |

As seen in the table, the use of the signals from more than one reaction zone in the calculation will reduce the imprecision in the determination. This experiment showed that the combined reading of the result in three reaction zones significantly reduces the imprecision or uncertainty of the result.

The invention claimed is:

1. An analysis device comprising a non-porous substrate having at least one sample addition zone, at least one sink, and at least one flow path connecting the at least one sample addition zone and the at least one sink, wherein the at least one flow path comprises projections substantially vertical to the surface of said substrate and having a height (H), diameter (D) and reciprocal spacing (t1, t2) such that lateral capillary flow of a liquid sample is achieved, and at least two reaction zones in series, wherein each reaction zone is adapted to facilitating measurement of a response originating from one and the same analyte, and wherein the reaction zones are positioned to allow calculation of the concentration of at least one analyte and wherein the reaction zone closet to the at least one sample addition zone is defined by an area which is different from the are of any one of the other reaction zones.

2. The analysis device according to claim 1, wherein the at least two reaction zones are positioned in one flow path.

3. The analysis device according to claim 1, wherein the reaction zone closest to the at least one sample addition zone has an area which is smaller than the area of any one of the other reaction zones.

4. The analysis device according to claim 1, wherein the at least two reaction zones have different geometries.

5. The analysis device according to claim 1, wherein the reaction zone closest to the at least one sample addition zone has a width dimension which is smaller than the width dimension of any one of the other reaction zones.

6. The analysis device according to claim 1, wherein each reaction zone comprises at least one reagent and wherein the concentrations of reagent in the at least two reaction zones are different.

7. The analysis device according to claim 1, wherein the reaction zone closest to the at least one sample addition zone has a concentration of reagent which is lower than the concentration of reagent in any one of the other reaction zones.

8. The analysis device according to claim 1, comprising at least two flow paths connecting the at least one sample addition zone and the at least one sink, and wherein each flow path comprises at least two reaction zones in series.

9. The analysis device according to claim 1, wherein the at least one flow path is at least partially open.

10. A system comprising an analysis device according to claim 1, and a reader adapted to read a response from each of the at least two reaction zones in series, wherein the reader comprises a microprocessor adapted to calculate a concentration based on the measured responses.

11. The system according to claim 10, wherein the reader comprises a fluorescence reader.

* * * * *

UNITED STATES PATENT AND TRADEMARK OFFICE

CERTIFICATE OF CORRECTION

PATENT NO. : 8,409,523 B2
APPLICATION NO. : 12/829151
DATED : April 2, 2013
INVENTOR(S) : Ib Mendel-Hartvig et al.

It is certified that error appears in the above-identified patent and that said Letters Patent is hereby corrected as shown below:

In the Claims

Correction of Claim 1 is requested as follows:
Column 8
Line 55, please change "and wherein the reaction zone closet to the at least one sample" to --and wherein the reaction zone closest to the at least one sample--
Line 57, please change "are of any one of the other reaction zones." to --area of any one of the other reaction zones.--

Signed and Sealed this
Twenty-sixth Day of May, 2015

Michelle K. Lee

Michelle K. Lee
*Director of the United States Patent and Trademark Office*